US005357862A

United States Patent [19]

Kohara

[11] Patent Number: 5,357,862

[45] Date of Patent: Oct. 25, 1994

[54] ROLLER HOLDING APPARATUS FOR PRINTING PRESS

[75] Inventor: Kazutaka Kohara, Chiba, Japan

[73] Assignee: Komori Corporation, Tokyo, Japan

[21] Appl. No.: 185,441

[22] Filed: Jan. 24, 1994

Related U.S. Application Data

[63] Continuation of Ser. No. 956,618, Oct. 5, 1992, abandoned.

[30] Foreign Application Priority Data

Oct. 11, 1991 [JP] Japan ..... 3-090929

[51] Int. Cl.[5] ..... B41F 31/34; B41F 13/20; B41G 27/32

[52] U.S. Cl. ..... 101/348; 101/352

[58] Field of Search ..... 101/348, 349, 350, 351, 101/352, 247, 148, 216, 219, 218; 384/116, 273, 502, 623

[56] References Cited

U.S. PATENT DOCUMENTS

| | | | |
|---|---|---|---|
| 1,977,375 | 10/1934 | Chandler | 101/349 |
| 2,861,516 | 11/1958 | Harless | 101/348 |
| 2,892,399 | 6/1959 | Chase | 101/349 |

*Primary Examiner*—J. Reed Fisher

*Attorney, Agent, or Firm*—Blakely, Sokoloff, Taylor & Zafman

[57] ABSTRACT

A roller holding apparatus for a printing press which holds bearing portions at two end portions of a roller includes an annular roller holding portion and a bolt. The annular roller holding portion is arranged at each of the two end portions and has a semicircular holder and a semicircular cap pivotally mounted on the semicircular holder and capable of being opened/closed. The bolt causes the holder and the cap of the roller holding portion to fix each of the bearing portions at the two end portions of the roller.

2 Claims, 3 Drawing Sheets

ROLLER HOLDING APPARATUS FOR PRINTING PRESS

This is a continuation of application Ser. No. 07/956,618 filed Oct. 5, 1992, now abandoned.

BACKGROUND OF THE INVENTION

The present invention relates to a roller holding apparatus for holding two end shafts of a roller provided to an inking or dampening arrangement of a printing press.

Inking and dampening arrangements are provided to a printing unit of, e.g., an offset printing press to supply an ink and dampening water, respectively, to a surface of a plate mounted on a plate cylinder. The inking arrangement has an ink fountain for storing the ink, an ink fountain roller dipped in the ink in the ink fountain and rotated, and a form roller detachably contacting the plate surface. A large number of vibrating and rubber rollers are disposed between the ink fountain roller and the form roller such that their circumferential surfaces are in contact with each other. The dampening arrangement has a water fountain for storing dampening water, a water fountain roller dipped in the water in the water fountain and rotated, a form dampening roller contacting the plate surface, and a plurality of water ductors disposed between the water fountain roller and the form dampening roller. Then, an image is formed on the surface of the plate with the ink and dampening water supplied to it from these arrangements, and the image is transferred to paper through a blanket cylinder, thus performing printing.

An end portion of a rubber roller provided to, e.g., the inking arrangement, of the inking and dampening arrangements that operate in this manner, has a structure as shown in the partially cutaway front view of FIG. 3 and the side view of FIG. 4. More specifically, a rectangular holding metal member or holder 2 is bolted to the free end portion of a roller arm or lever 1, and an end shaft 3*a* of a roller holder 3 is inserted in and fixed to a bearing hole 2*a* of the holding metal member 2 by split clamping. The outer ring of a roll bearing 4 is fitted in a bearing hole 3*b* of the roller holder 3, and an end shaft 5*a* of a rubber roller 5 is pressed in the inner ring of the roll bearing 4. The rubber roller 5 contacts a vibrating roller 6 (not shown) and another vibrating roller (not shown). The axis of the rubber roller 5 and that of the roller holder 3 are deviated from each other by t in FIG. 2. Reference numeral 3*c* denotes a hole in which a wrench is inserted to pivot the roller holder 3.

With this arrangement, during a printing operation, the ink on the rotating vibrating roller 6 is transferred to the rubber roller 5 and distributed, and transferred to another vibrating roller and distributed uniformly in the respective directions. Prior to the printing operation, when the wrench is inserted in the hole 3*c* to rotate the roller holder 3, the distance between the axes of the roller holder 3 and the vibrating roller 6 is slightly changed by eccentricity, thereby adjusting the nip pressure between the rubber and vibrating rollers 5 and 6.

When the rubber roller 5 is to be replaced due to wear, a bolt 2*b* fixing the lever 1 and the holder 2 is loosened to be removed, and the rubber roller 5, the roller holder 3, and the holder 2 are integrally taken out of the printing press. The roller holder 3 and the holding metal member 2 removed from the rubber roller 5 are mounted on a new rubber roller 5 outside the printing press and fixed to the lever 1 by the bolt 2*b*. Then, nip pressure adjustment described above is performed.

In this conventional roller holding apparatus, however, when the rubber roller 5 is to be replaced or maintained, it must be removed from and attached to the lever 1 while the roller holder 3 and the holder 2 are mounted on it. Hence, the operation is cumbersome and time-consuming. Furthermore, the roller holder 3, the holding metal member 2, the bolt 2*b*, and the like may accidently drop into the printing press to damage another roller or components. Thus, a safe replacement operation is not performed. A holding apparatus of the rubber roller of the inking arrangement has been described so far. However, the same problem arises in other rollers of the inking arrangement or in the rollers of the dampening arrangement.

SUMMARY OF THE INVENTION

The present invention has been made in view of the above problem, and has as its object to provide a roller holding apparatus for a printing press which enables an easy and safe roller replacement operation.

In order to achieve the above object, according to the present invention, there is provided a roller holding apparatus for a printing press which holds bearing portions at two end portions of a roller, comprising an annular roller holding portion arranged at each of the two end portions and having a semicircular fixing member and a semicircular opening/closing member pivotally mounted on the semicircular fixing member and capable of being opened/closed, and fixing means for causing the fixing member and the opening/closing member of the roller holding portion to fix each of the bearing portions at the two end portions of the roller.

When the roller is to be replaced or maintained, the bolt of the roller holding portion is loosened to open the opening/closing member. The roller having the bearings mounted on it is removed to the outside of the printing press and replaced by a new roller or maintained. Thereafter, the replaced or maintained roller is supported by the fixing member of the roller holding portion, the opening/closing member is closed, and the bolt is clamped, thus completing the roller replacement or maintenance operation.

DESCRIPTION OF THE PREFERRED EMBODIMENT

Figure 1:
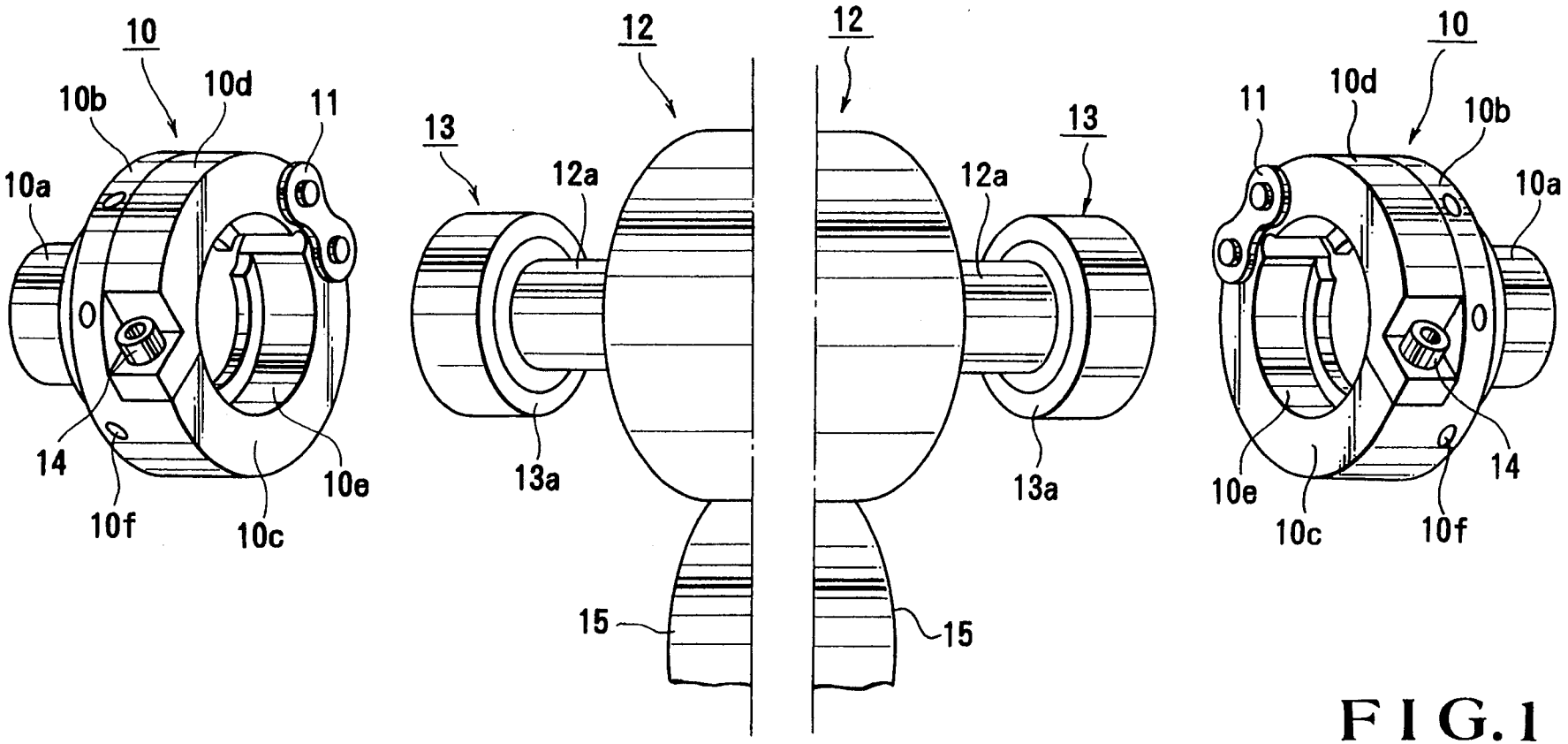
FIG. 1 is a perspective view of a rubber roller support portion.
Figure 2:
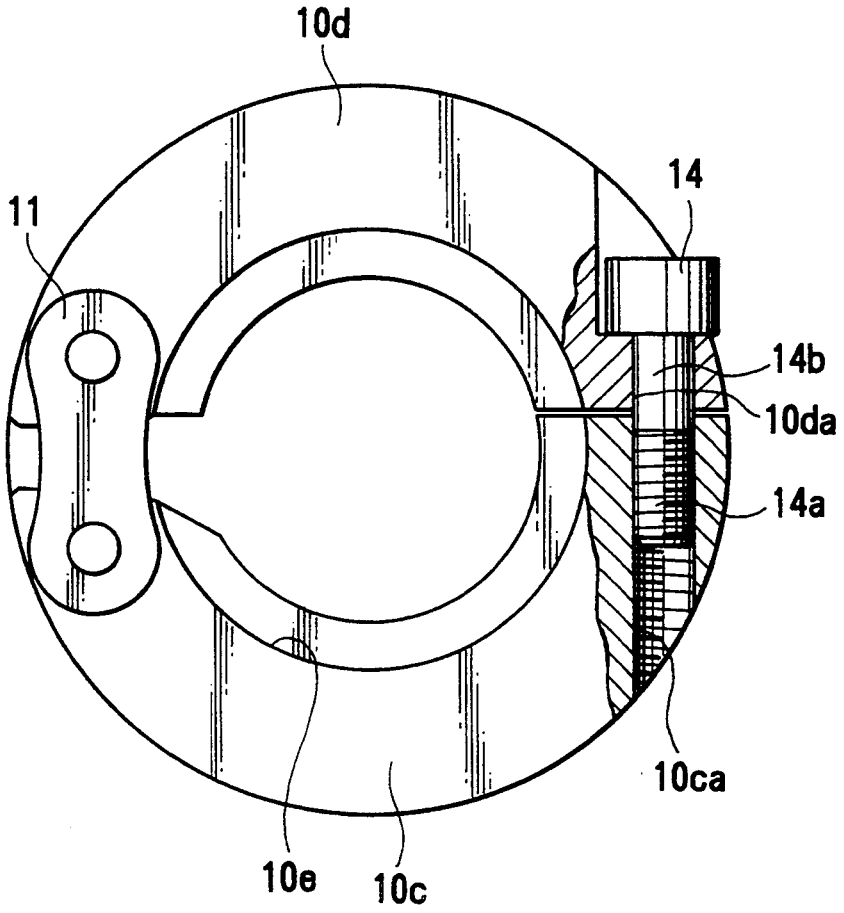
FIG. 2 is a partially cutaway front view of a roller holder shown in FIG. 1.
Figure 3:
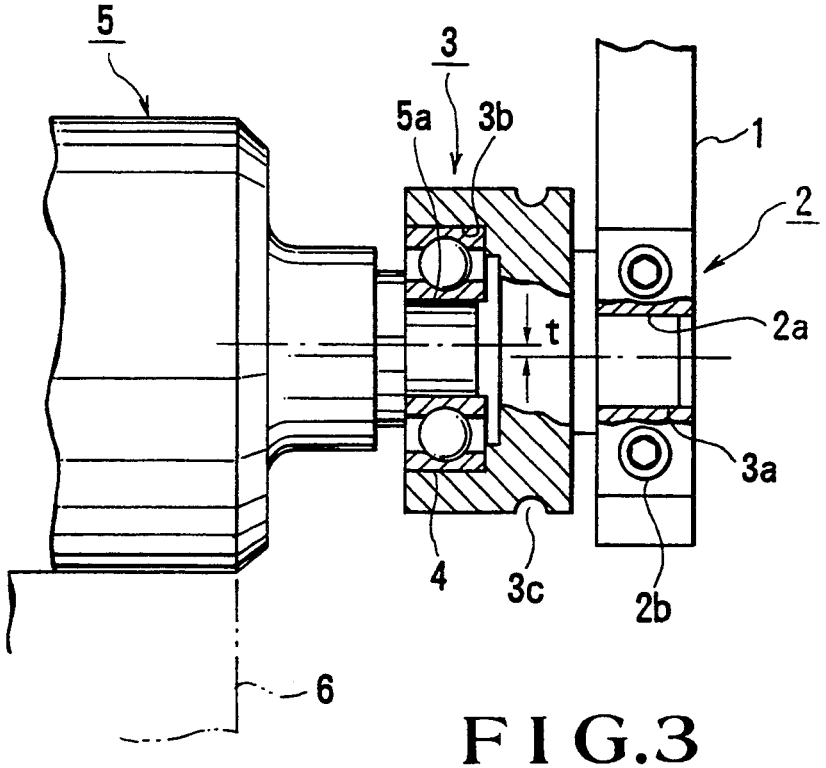
FIG.3 PRIOR ART
FIG. 3 is a partially cutaway front view of an end portion of a conventional rubber roller.
Figure 4:
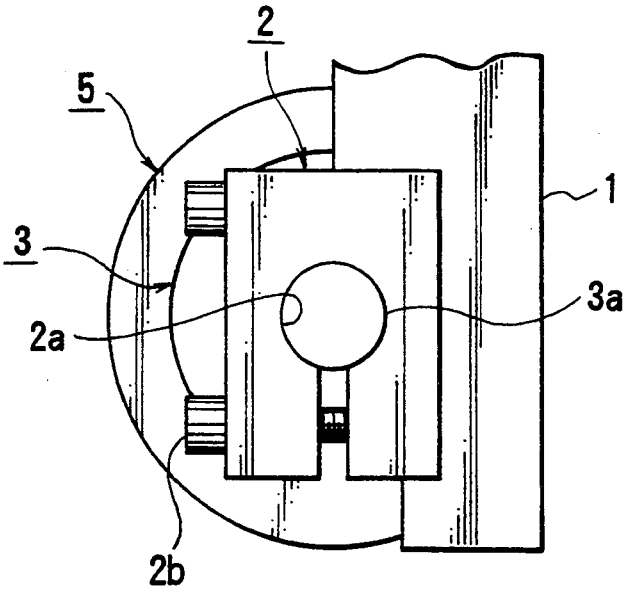
FIG.4 PRIOR ART
FIG. 4 is a side view of the end portion of the conventional rubber roller.

FIGS. 1 and 2 show a rubber roller support portion in which a roller holding apparatus for a printing press according to the present invention is applied to the rubber roller of an inking arrangement. A roller 12 has the same support structures at its two ends, and only one support structure will be described. Referring to FIG. 1, a roller holder 10 is integrally formed of an end shaft 10*a* to fit in a hole of a holding metal member formed in the free end portion of a roller arm (not shown), and a bottomed cylindrical roller holding portion 10*b* continuous to the end shaft 10*a*. A roll bearing 13 as an example of a bearing is mounted on the step portion (not shown) of an end shaft 12*a* of the rubber roller 12. The front half of the roller holding portion 10*b* in the axial direction is formed of a holder 10*c* serving as a semicircular fixing member, and a cap 10*d* pivotally mounted on the holder 10*c* through a link 11 to be capable of being opened/closed. A circular groove 10*e* in which the outer ring of the roll bearing 13 is to be fitted is formed in the inner circumferential surfaces of the holder 10*c* and the cap 10*d*.

A bolt 14 for fixing the cap 10*d* on the holder 10*c* after the roll bearing 13 is fitted in the groove 10*e* is provided between the contact portion of the cap 10*d* and the holder 10*c* as it is threadably engaged in the screw hole 10*ca* of the holder 10*c* as shown in FIG. 2. In this case, a screw hole 10*da* having the same pitch and diameter as those of the screw hole 10*ca* of the holder 10*c* is formed in the cap 10*d*, and a non-threaded portion 14*b* having a diameter smaller than the minor diameter of the screw hole 10*da* is formed on a portion of the bolt 14 close to the head portion. With this arrangement, when the bolt 14 is fully screwed into the corresponding screw hole 10*ca*, the non-threaded portion 14*b* of the bolt 14 is loosely fitted in the screw hole 10*da* of the cap 10*d*. When the bolt 14 is loosened in this state, its threaded portion 14*a* is engaged with the screw hole 10*da* of the cap 10*d*. Even if the threaded portion 14*a* of the bolt 14 is exposed from the screw hole 10*ca* of the holder 10*c*, the threaded portion 14*a* of the bolt 14 is kept engaged with the screw hole 10*da* of the cap 10*d*, so that the bolt 14 will not drop into the printing press.

The axis of the groove 10*e* concentric with the rubber roller 12 and that of the end shaft 10*a* are eccentric from each other by a predetermined amount. When the wrench is inserted in a hole 10*f* of the roller holder 10 and rotated while the rubber roller 12 is supported by the roller holder 10, the nip pressure between the rubber roller 12 and a vibrating roller 15 is adjusted by a predetermined amount.

With this arrangement, during a printing operation, the ink on the rotating vibrating roller 15 is transferred to the rubber roller 12 and distributed, and transferred to another vibrating roller and distributed uniformly in the respective directions. Prior to the printing operation, when the wrench is inserted in the hole 10*f* to rotate the roller holder 10, the axis-to-axis distance between the groove 10*e* coaxial with the rubber roller 12 and the end shaft 10*a* is slightly changed by the eccentricity, thereby adjusting the nip pressure between the rubber and vibrating rollers 12 and 15.

When the rubber roller 12 is to be replaced due to wear, the bolt 14 is loosened to remove its threaded portion from the screw hole of the holder 10. Since the cap 10*d* and the holder 10*c* are disengaged from each other, the cap 10*d* is opened about the link 11 as the center, and the rubber roller 12 together with the roll bearing 13 mounted on it is removed to the outside of the printing press. The rubber roller 12 is replaced with a new rubber roller outside the printing press, the roll bearing 13 is mounted on the new rubber roller 12, the rubber roller 12 is supported by the holder 10*c* such that the roll bearing 13 is fitted in the grove 10*e*, the cap 10*d* is closed, and the bolt 14 is clamped, thereby completing mounting of the rubber roller 12.

During the replacement operation of the rubber roller 12 as described above, only the roll bearing 13 accompanies the rubber roller 12 which is removed to the outside of the printing press or is mounted in the apparatus. Thus, the rubber roller 12 can be easily mounted and removed, and nothing drops into the printing press, ensuring safety. In this embodiment, since a screw hole to engage with the bolt 14 is formed also in the cap 10*d*, even if the cap 10*d* is open, the bolt 14 remains on the cap 10*d*. The bolt 14 will not drop into the printing press, further improving the safety.

In this embodiment, the roller holding apparatus according to the present invention is applied to the rubber roller of the inking arrangement. However, the present invention is not limited to this, and can be similarly applied to other rollers provided in the inking arrangement or to a variety of rollers of the dampening arrangement. A roller for practicing the present invention need not be a rubber roller having an elastic surface but may be a roller having a metal surface.

Furthermore, in this embodiment, the holder 10 is held on the free end portion of the roller arm. However, the holder 10 may be held on the frame by a bracket or the like. In this embodiment, the bolt 14 serves as the fixing means for fixing the cap 10*d* and the holder 10*c*. However, the cap 10*d* and the holder 10*c* may be fixed by another fixing means. When the present invention is applied to a vibrating roller, the vibrating mechanism of the vibrating roller may be provided outside the vibrating roller. Alternatively, a cylindrical cam which rotates together with the vibrating roller may be provided inside the vibrating roller, and the vibrating roller may be interlocked with the rotation of the cylindrical cam, thereby reciprocating the vibrating roller. In this embodiment, the axis of the groove 10*e* and that of the end shaft 10*a* are set eccentric from each other. However, they need not always be eccentric from each other.

As is apparent from the above description, according to the present invention, there is provided a roller holding apparatus for a printing press which holds bearing portions at two end portions of a roller, comprising an annular roller holding portion arranged at each of the two end portions and having a semicircular fixing member and a semicircular opening/closing member pivotally mounted on the semicircular fixing member and capable of being opened/closed, and a fixing means for causing the fixing member and the opening/closing member of the roller holding portion to fix each of the bearing portions at the two end portions of the roller. To replace, maintain, or wash the roller, the bolt is loosened and only the cap is opened to mount or remove the roller together with only the bearings mounted on it. Therefore, the roller replacement operation can be easily performed within a short period of time, the operating performance is improved, the labor is decreased, and unlike in the conventional roller holding apparatus, a member which accompanies the roller during mounting and removing will not drop into the printing press, thereby improving the durability and safety of a component, e.g., a lower roller.

What is claimed is:

1. A roller holding apparatus for a printing press which holds bearing portions at two end portions of a roller, comprising:

an annular roller holding portion arranged at each of said two end portions, the annular roller holding portion including a fixing member having a first screw hole, and an opening and closing member pivotally mounted on said fixing member and capable of being opened and closed, the opening and closing member having a second screw hole substantially equal in diameter to the first screw hole; and fixing means for causing said fixing member and said opening and closing member of said roller holding portion to secure each of said bearing portions at said two end portions of said roller, said fixing means includes a bolt having a plurality of portions, wherein a first portion of the bolt immediately adjacent to a head portion is non-threaded and has a smaller diameter than a second portion of the bolt, said second portion is threaded and engages with the first screw hole when the annular roller holding portion is in a closed position, said second portion of the bolt also engages with the second screw hole when the annular roller holding portion is in an open position.

2. A roller holding apparatus according to claim 1, wherein each said roller holding portion has an end shaft for supporting each said holding portion and a groove on each said holding portion for supporting a respective one of said end portions of said roller, wherein an axis of each groove is eccentric with an axis of each respective end shaft of said roller holding portion.

* * * * *